United States Patent [19]

Sato et al.

[11] Patent Number: 4,477,491

[45] Date of Patent: Oct. 16, 1984

[54] ONE-SIDE ZINC HOT DIPPING PROCESS USING AN ANTI-PLATING AGENT

[75] Inventors: Kuniaki Sato; Hisao Yasunaga; Takahisa Yoshihara; Yoshinori Fujita; Kazuaki Kyono, all of Chiba, Japan

[73] Assignee: Kawasaki Steel Corporation, Hyogo, Japan

[21] Appl. No.: 422,475

[22] Filed: Sep. 23, 1982

[30] Foreign Application Priority Data

Nov. 18, 1981 [JP] Japan ..... 56-184702

[51] Int. Cl.[3] ..... B05D 3/02; B05D 3/12

[52] U.S. Cl. ..... 427/211; 427/300; 427/359; 427/397.8

[58] Field of Search ..... 427/300, 359, 360, 346, 427/331, 209, 211, 365, 156, 397.8; 134/15, 16

[56] References Cited

U.S. PATENT DOCUMENTS 3,181,963 5/1965 Cook et al. ..... 427/300

FOREIGN PATENT DOCUMENTS 55-24951 2/1980 Japan ..... 427/300

55-119158 9/1980 Japan ..... 427/300

*Primary Examiner*—Evan K. Lawrence

*Attorney, Agent, or Firm*—Young & Thompson

[57] ABSTRACT

One-side zinc hot dipped steel sheets are produced by coating one surface of a steel sheet with an aqueous slurry of an anti-plating agent based on MgO, alkali metal silicates, boric acid, MOH (M is an alkali metal) and the like and containing such additives as $TiO_2$ and $Al_2O_3$, heating the coated sheet for drying and baking, immersing the steel sheet with an anti-plating film in a molten zinc bath to zinc plate the other surface of the sheet, wetting the anti-plating film, and bending the steel sheet to cause the anti-plating film to peel off, thereby removing the anti-plating film from the steel sheet. This invention carries out the coating and baking of the anti-plating agent such that it is baked to a film having a thickness of 20 to 60 microns at a temperature of 750° C. to about 930° C.

5 Claims, 3 Drawing Figures

ONE-SIDE ZINC HOT DIPPING PROCESS USING AN ANTI-PLATING AGENT

BACKGROUND OF THE INVENTION

This invention relates to the so-called zinc hot dipping process, and more particularly, to a processs for producing a one-side zinc hot dipped steel sheet by the utilization of a water-glass type anti-plating agent. More specifically, this invention is concerned with the baking of an anti-plating coating capable of preventing entrainment of zinc to the anti-plating film and ensuring complete removal of the antiplating film.

The applicant has made a number of proposals for the manufacture of one-side zinc hot dipped steel sheets using anti-plating agents based on water-glass (alkali metal silicates), boric acid, magnesium oxide, alkali metal hydroxides, etc. and containing an additive in the form of a metal oxide such as $TiO_2$ and $Al_2O_3$. This one-side zinc hot dipping process using an anti-plating agent takes advantage of little adhesion between a film of such an anti-plating agent and molten zinc. The anti-plating agent is applied to a steel sheet and then dried and baked to form an anti-plating film before the steel sheet is immersed in a molten zinc bath. It has been found that the adhesion between the anti-plating film and molten zinc varies with the baking conditions since the surface nature of the anti-plating film largely depends on the baking conditions. Depending on the conditions under which the anti-plating coating is baked, there is a likelihood that zinc will be deposited or entrained on the surface of the anti-plating film. Such entrained zinc particles are carried with the continuously moving steel sheet and transferred to rolls and other transport members in the system, making dents in the steel sheet. After plating of the other surface of the steel sheet with zinc, the antiplating film is removed from the sheet by subjecting the sheet to bending by suitable bending means such as a roll bender, thereby causing the anti-plating film to peel off through the utilization of a difference in flexural strength between the steel sheet and the anti-plating film. Should a few number of zinc particles be entrained on the anti-plating film, dents or flaws would occur in the steel sheet during the peeling processs. In some cases, the anti-plating film cannot be completely removed from the steel sheet by means of relatively simple bending machinery.

SUMMARY OF THE INVENTION

Therefore, an object of this invention is to bake a coating of an anti-plating agent on a steel sheet in a one-side zinc hot dipping process of the above-mentioned type such that deposition and entrainment of zinc onto the surface of the anti-plating film may be fully prevented upon emergence of the steel sheet from a molten zinc bath, and the anti-plating film may be completely removed using relatively simple bending machinery.

This invention is directed to a process for producing a one-side hot dipped steel sheet by coating one surface of the steel sheet with an aqueous slurry of an anti-plating agent, said anti-plating agent being based on magnesium oxide, alkali metal silicates, boric acid, alkali metal hydroxides, and the like, and containing an additive in the form of a metal oxide such as $TiO_2$ and $Al_2O_3$; heating the coated sheet for drying and baking to form an anti-plating film on one surface of the sheet; immersing the sheet with the anti-plating film in a molten zinc bath to plate the other surface of the sheet with zinc; rendering the anti-plating film wet, and subjecting the sheet to bending, thereby peeling off and removing the anti-plating film from the steel sheet. According to the feature of this invention, the coating and baking of the anti-plating agent are carried out under conditions meeting the following inequalities:

$X \geqq 750$, $Y \geqq 2.27X - 2051.1$, and $20 \leqq Y \leqq 60$ wherein X is the baking temperature in °C. and Y is the thickness of the dry anti-plating film in microns, in order to prevent entrainment of zinc on the anti-plating film and to ensure complete removal of the anti-plating film. When the baking temperature exceeds 800° C., the steel sheet having the antiplating agent coated thereon may desirably be retained for a time of 60 seconds or shorter at a temperature of above 800° C.

BRIEF DESCRIPTION OF THE DRAWINGS

These and other objects, features and advantages of the present invention will be more fully understood from the following description taken in conjunction with the accompanying drawings.

DESCRIPTION OF THE PREFERRED EMBODIMENTS

Figures 1, 2:
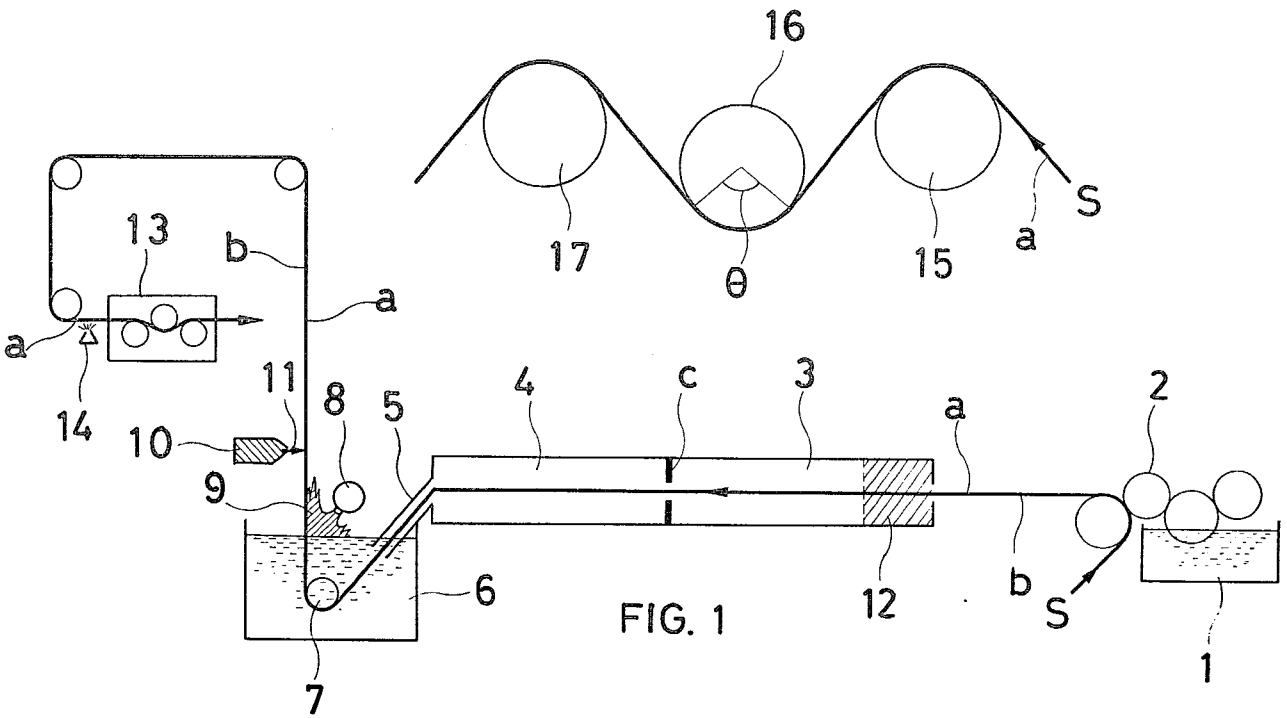
FIG. 1 is a diagramatic illustration of a system for carrying out the process of the invention.
FIG. 2 is an enlarged view of a roll bending machine used in the system shown in FIG. 1.

Referring to FIG. 1, there is shown a typical system to which the process of the invention is applicable. A strip or sheet S of steel is fed in the direction of an arrow from a source (not shown) to a roll coater 2 where an anti-plating agent is applied to one surface or plating-free surface a of the steel sheet S from an anti-plating agent bath 1. The steel sheet S having a coating of the anti-plating agent is then passed through an annealing furnace including heating and cooling zones 3 and 4. In the heating zone 3, the steel sheet S with the anti-plating coating is heated for drying and baking the anti-plating coating. The temperature at which the anti-plating coating is baked (to be referred to as baking temperature) may be regarded as designating the temperature of the steel sheet since the anti-plating film has a thickness of a substantial fraction of the thickness of the steel sheet S at the outlet C of the heating zone 3 so that the temperature of the anti-plating film is essentially equal to that of the steel plate. After the anti-plating film is baked in the heating zone 3 at a suitable heating temperature as will be described later, the steel sheet S with the baked anti-plating film is cooled to a temperature of about 500° C. in the cooling zone 4. The steel sheet S is then immersed into a molten zinc bath 6 through a chute 5 downward extending aslant from the outlet of the furnace. In the bath 6, zinc is plated to the other surface or plating surface b of the steel sheet S by a hot dipping process. The steel sheet S is turned around a sink roll 7 in the bath 6 and emerges from the bath vertically upward. Zinc adhering to or entraining on the anti-plating film is wiped off by means of a flame wiper 8 which directs flame 9 toward the anti-plating film-carrying surface a of the steel sheet. On the zinc plated surface b, the plating thickness is controlled by means of a plating thickness control device 10 which ejects air or steam jets 11 toward the zinc plated surface b of the steel sheet. After removal of the entraining zinc on surface a and thickness control of the plated zinc on surface b, the steel sheets having the anti-plating film on one surface and the zinc plating on the other surface is transported to the subsequent anti-plating film peeling step through a series of guide rollers. The steel sheet is moved across a water spray 14 where water is sprayed to the anti-plating film to render it wet, immediately before the steel sheet is introduced into a roll bending machine 13 including three rolls 15, 16 and 17 where it is bent at a desired bending angle. Bending causes the anti-plating film to completely peel off and remove from the steel sheet. The thus exposed surface of the steel sheet remains in a cold-rolled state. A one-side zinc hot dipped steel sheet is thus obtained.

In the one-side zinc hot dipping process using an anti-plating agent based on an alkali metal silicate, boric acid, magnesium oxide (MgO), an alkali metal hydroxide (MOH wherein M is an alkali metal) and the like and containing an additive in the form of a metal oxide such as titanium oxide ($TiO_2$) and aluminum oxide ($Al_2O_3$), the present invention aims to prevent entrainment of zinc on the anti-plating film from the molten zinc bath and to ensure complete removal of the anti-plating film from the steel sheet. Entrainment or adhesion of zinc to the anti-plating film depends on the strength of adhesion between the anti-plating film and molten zinc. The surface nature of the anti-plating film is closely related to the baking temperature at which it is baked. For the water-glass type anti-plating agent used in the present invention, the lower the baking temperature, the lower the function of the anti-plating film becomes due to underbaking, and the higher the baking temperature, the lower the strength of adhesion between the anti-plating film and zinc becomes due to increasing vitrification. Further elevated temperatures will cause the anti-plating film to be fully vitrified into a coarser vitrified crystalline structure, which again increases its adhesion to zinc to allow for entrainment of zinc. The second aspect is to completely peel and remove the anti-plating film by bending. The flexural strength of the anti-plating film is decreased with the increasing degree of vitrification, and hence, depends on the baking temperature. With respect to film thickness, the thicker films are more brittle under flexure and prone to cracking.

These findings are derived from a series of experiments the inventors carried out using an anti-plating agent as specified below to examine how the surface nature of the anti-plating film and the baking temperature influence the adhesion or entrainment of zinc and how the thickness of the anti-plating film and the baking temperature influence the peeling and removal of the anti-plating film by bending. The surface nature of the anti-plating film was examined by microphotographic and fluorescent X-ray analyses.

The anti-plating agent used was an aqueous slurry which was prepared by adding 9 parts of $TiO_2$ and 9 parts of $Al_2O_3$ to 23 parts of an alkali metal silicate, 11 parts of NaOH, 17 parts of boric acid and 32 parts of MgO in water, parts being parts by weight. The slurry was applied to one surface of 0.7-mm thick steel sheets to varying thicknesses by means of a roll coater as shown in FIG. 1. The anti-plating agent coated steel sheets were fed into the annealing furnace in the form of a radiant tube having a reducing atmosphere consisting of 75–85% $N_2$ and 25–15% $H_2$ and having a dew point of −10° C. to −20° C. A 4-m long inlet section 12 of the heating zone 3 was adjusted to a temperature of 500° C. and the feed speed was 40–70 m/min. Under these conditions, the steel sheets with the anti-plating agent were baked at different temperatures. Zinc dipping was carried out in a molten zinc bath at a temperature of 470 to 490° C. Thereafter, the anti-plating film was examined for adhesion or entrainment of zinc thereon. The baking temperature was measured by means of a radiant thermometer positioned at C in the furnace shown in FIG. 1, since the furnace was designed such that the temperature became maximum at position C.

Bending of the anti-plating film for peeling was carried out as shown in the enlarged view of FIG. 2 after the anti-plating film on the steel sheet was wetted by means of the water spray to a water content of 4 $g/m^2$ or higher. The steel sheet S having the anti-plating film wetted was introduced into the roll bending machine 13. The bending roll 16 was arranged between compression rolls 15 and 17 such that the steel sheet S was wound around the bending roll 16 over a contact angle $\theta$ of 60° or more. The anti-plating film was peeled off and removed by this bending. The resulting steel sheet was inspected for removal of the anti-plating film.

Figure 3:
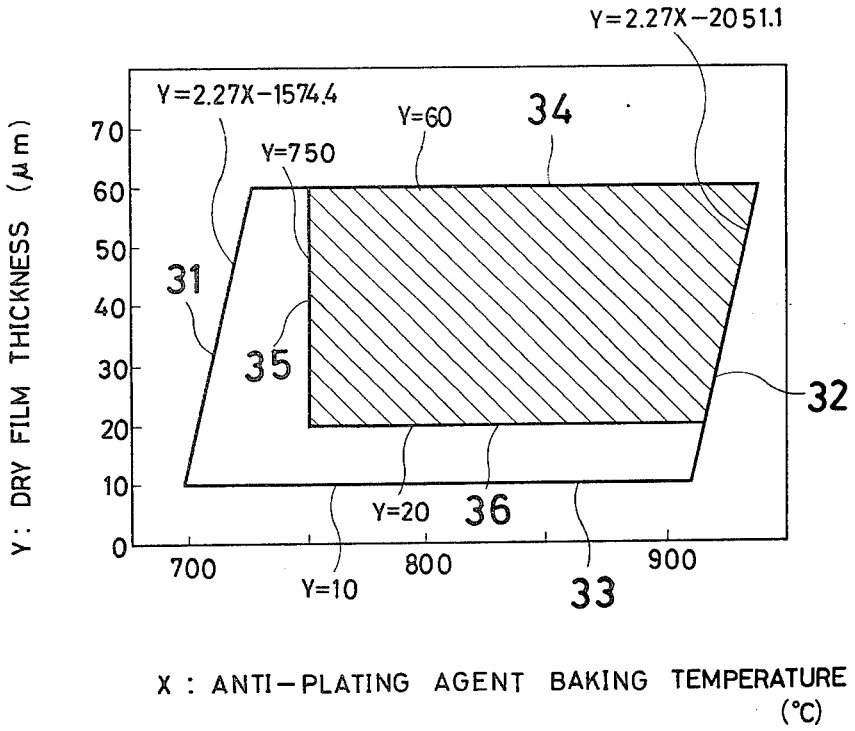
FIG. 3 is a diagram showing the relationship of the baking temperature to the film thickness in the process of the invention.

The results are plotted in the graph of FIG. 3 wherein the abscissa X represents the maximum baking temperature of the anti-plating film in degree centigrade (°C.) and the ordinate Y represents the thickness of the dry anti-plating film in micron (μm). From the first aspect of preventing entrainment of zinc on anti-plating film, line 31 in FIG. 3 is a border line outside which film baking is short, line 32 is a border line outside which the anti-plating film is excessively vitrified due to over-baking, and lines 33 and 34 show lower and upper limits of film thickness to which the anti-plating film may be effectively applied by means of a roll coater. When the film thickness is below line 33, that is, below 10 microns, an initial coating widely varies in thickness and such a coating is baked into a dry film having an excessively irregular surface. Film thicknesses above line 34, that is, above 60 microns are unnecessary and expensive for the anti-plating purpose. From the second aspect of completely peeling and removing the anti-plating film by bending, it has been found that the following conditions must be met in addition to the above-mentioned conditions. Line 35 shows a limit of baking temperature below which the anti-plating film cannot be completely peeled off. Film thicknesses above line 36, that is, above 20 microns (inclusive) are necessary since the baked anti-plating film becomes more brittle and more prone to cracking as the film thickness increases. In summary, the region within which the entrainment of zinc on the anti-plating film surface is fully prevented and the complete removal of the anti-plating film is ensured is a shaded region in FIG. 3. This region is defined by the following inequalities:

$X \geqq 750$, $Y \geqq 2.27X - 2051.1$, and $20 \leqq Y \leqq 60$ wherein X represents the baking temperature in °C. and Y represents the thickness of the dry anti-plating film in microns.

When the anti-plating film on a steel sheet is baked within the above-mentioned region, little zinc is entrained by or adhered to the anti-plating film surface after zinc hot dipping, and the resultant one-side galvanized steel sheet shows an aesthetic cold-rolled surface since the anti-plating film is completely removed by wet bending. Baking temperatures exceeding 800° C. tend to promote the vitrification of an anti-plating film. It has been found that when an anti-plating film is retained at such a higher baking temperature for 60 seconds or longer, the vitrification proceeds too much to prevent entrainment of zinc. Therefore, the retention time at temperatures above 800° C. may preferably be shorter than 60 seconds.

In the above-mentioned embodiment, an anti-plating agent is applied to a steel sheet immediately before entering an annealing furnace and the inlet of the furnace is kept at a relatively low temperature to provide for moderate temperature rise to prevent formation of an irregular film surface attributable to rapid temperature rise. Similar results are obtained when the coating of an anti-plating agent is followed by drying to evaporate off the water in the anti-plating coating before the steel sheet enters an annealing furnace.

What we claim is:

1. A process for producing a one-side zinc hot dipped steel sheet, comprising the steps of coating one surface of a steel sheet with an aqueous slurry of an anti-plating agent, said anti-plating agent containing 9 parts by weight of $TiO_2$, 9 parts by weight of $Al_2O_3$, 23 parts by weight of an alkali metal silicate, 11 parts by weight of NaOH, 17 parts by weight of boric acid and 32 parts by weight of MgO, heating the coated sheet for drying and baking to form an anti-plating film on one surface of the steel sheet, immersing the steel sheet with the anti-plating film in a molten zinc bath to plate the other surface of the steel sheet with zinc, rendering the anti-plating film wet, and subjecting the steel sheet to bending, thereby peeling off and removing the anti-plating film from the steel sheet, characterized in that the coating and baking of the anti-plating agent are carried out under conditions meeting the following inequalities:

$X \geqq 750$, $Y \geqq 2.27X - 2051.1$, and $20 \leqq Y \leqq 60$ wherein X is the baking temperature in °C. and Y is the thickness of the dry anti-plating film in microns, in order to prevent entrainment of zinc on the anti-plating film and to ensure complete removal of the anti-plating film.

2. The process according to claim 1 wherein the steel sheet having the anti-plating agent coated thereon is retained for a time of 60 seconds or shorter at a temperature of above 800° C. for baking.

3. The process according to claim 1 wherein the steel sheet is coated with the anti-plating agent in slurry form by means of a roll coater.

4. The process according to claim 1 wherein the bending of the steel sheet having the anti-plating film wetted is carried out by passing the sheet through a roll bending machine.

5. The process according to claim 1 wherein the steel sheet is subjected to bending in a roll bending machine and said roll bending machine includes three parallel rolls, the steel sheet being wound about alternately opposite sides of said rolls and around the intermediate roll over a contact angle of at least 60°.

* * * * *